US005920759A

United States Patent [19]

Ushiroji et al.

[11] Patent Number: 5,920,759

[45] Date of Patent: Jul. 6, 1999

[54] SHEET CURL CORRECTING MECHANISM AND IMAGE FORMING APPARATUS HAVING THE MECHANISM

[75] Inventors: Takahiko Ushiroji; Ritsuo Fujii, both of Hachioji, Japan

[73] Assignee: Konica Corporation, Japan

[21] Appl. No.: 08/996,376

[22] Filed: Dec. 22, 1997

[30] Foreign Application Priority Data

Dec. 26, 1996 [JP] Japan ..... 8-348521

[51] Int. Cl.[6] ..... B65H 20/00; G03G 15/00

[52] U.S. Cl. ..... 399/406; 162/271; 399/44; 399/45; 399/92

[58] Field of Search ..... 399/406, 44, 45, 399/92, 97, 400; 271/188, 161, 209; 162/270, 271, 197

[56] References Cited

U.S. PATENT DOCUMENTS

| | | | |
|---|---|---|---|
| 4,652,110 | 3/1987 | Sato et al. | 399/406 |
| 5,153,662 | 10/1992 | Foos | 399/406 |
| 5,357,327 | 10/1994 | Solano et al. | 399/406 |
| 5,392,106 | 2/1995 | Bigenwald et al. | 399/406 |
| 5,414,503 | 5/1995 | Siegel et al. | 399/406 |
| 5,515,152 | 5/1996 | Kuo | 399/406 |
| 5,787,331 | 7/1998 | Ohkuma et al. | 399/406 |

FOREIGN PATENT DOCUMENTS

| | | |
|---|---|---|
| 5-341601 | 12/1993 | Japan . |
| 6-115792 | 4/1994 | Japan . |
| 6-144679 | 5/1994 | Japan . |
| 6-156852 | 6/1994 | Japan . |

*Primary Examiner*—Sandra Brase
*Assistant Examiner*—Sophia S. Chen
*Attorney, Agent, or Firm*—Jordan B. Bierman; Bierman, Muserlian and Lucas

[57] ABSTRACT

An electrophotographic image forming apparatus having a sheet curl correcting mechanism includes: a rotary body including either an endless annular belt or a roller; and a pressing roller for pressing the rotary body, wherein the curled recording sheet on which a toner image is formed is inserted between the rotary body and the pressing roller thereby bending force is applied to the curled recording sheet in a direction opposite to a curl of the curled recording sheet so that the curl is corrected. The apparatus further includes an air flow generator for applying an air flow to a curled recording sheet and the sheet curl correcting mechanism.

12 Claims, 6 Drawing Sheets

SHEET CURL CORRECTING MECHANISM AND IMAGE FORMING APPARATUS HAVING THE MECHANISM

BACKGROUND OF THE INVENTION

The present invention relates to a sheet curl correcting mechanism composed of a rotary object that is either one of an endless annular belt and a roller and of a roller which is in pressure contact with the rotary object, wherein a curled sheet is caused to pass through the contact surface between the rotary object and the roller to be subjected to the bending force in the direction opposite to that of the curl so that the curl of the sheet is corrected, and to an electronic image forming apparatus having therein the curl correcting mechanism.

Next, an example in prior art will be explained referring to drawings. FIG. 4 is a structural diagram of an electrophotographic copying machine representing an example of an electronic image forming apparatus having therein an automatic duplex unit (ADU unit).

In the diagram, the numeral 100 is an electrophotographic copying machine main body, 200 represents a sheet-feeding unit (PFU unit), 300 represents an automatic document feeder (ADC) and 400 represents a finisher device (finisher (sorter with stapler device) FNS device).

The electrophotographic copying machine main body 100 is composed of scanning exposure section 110 which scans an entire surface of document D with a slit-shaped light, then leads optical information reflected on the document D to a photoreceptor drum through mirrors and a lens and forms an electrostatic latent image on the photoreceptor drum, image forming section 120 which visualizes the electrostatic latent image on the photoreceptor drum by the use of toner (developing agent) and transfers it onto copy sheet P, sheet-feeding section 130 which feeds copy sheet P to the image forming section 120, conveyance section 140 which conveys copy sheet P, fixing section 150 which is composed of heating roller 150*a* and pressure roller 150*b* and heat-fixes toner on the copy sheet P with heat of the heating roller 150*a*, sheet-ejection switching section 160, plural sheet-feeding cassettes 170 and automatic duplex unit (ADU unit) 180.

One-dot chain lines in the drawing show a conveyance path for the copy sheet P. The conveyance path includes two types, one is a main route and the other is a circulating route.

The main route is one through which copy sheet P loaded in sheet-feeding cassette 170 or sheet-feeding unit 200 provided in the lower part of the electrophotographic copying machine main body 100 is led to be contained in finisher device 400 through the conveyance section 140, fixing section 150 and sheet-ejection switching section 160 after the image forming conducted by the image forming section 120. The circulation route is a route through which copy sheet P branched from the sheet-ejection switching section 160 is fed again to reach the sheet-feeding section 130 of the electrophotographic copying machine main body 100, after being stocked temporarily in automatic duplex unit 180.

In the electrophotographic copying machine having the aforesaid constitution, the surface of copy sheet P having thereon toner T is heated by heating roller 150*a* in the fixing section 150 as shown in FIG. 5 (A). In this case, moisture on the surface of the copy sheet on the part of the heating roller 150*a* and that on the part of the pressure roller 150*b* differ from each other to cause curl on the copy sheet P.

With regard to the direction of the curl of copy sheet P, W. Gallay's theory has been known, namely, it is known that a sheet is curled with its side dried later than the other side being concaved. Since the surface of copy sheet P having thereon toner T on the part of heating roller 150*a* is dried first and the surface on the part of pressure roller 150*b* is dried later, the copy sheet is curled with its surface dried later, namely the surface on the part of pressure roller 150*b* being concaved as shown in FIG. 5 (B).

Accordingly, when copy sheet P after being fixed is subjected to image forming again through automatic duplex unit 180, a means to correct the curled copy sheet P is needed for preventing a jam caused by poor conveyance.

Curl correcting means in prior art includes the following.

(a) An air flow is applied on copy sheet P which has been fixed to accelerate moisture evaporation on the surface of the copy sheet P on the part of pressure roller 150*b* and thereby to reduce a difference of moisture from that on the part of the heating roller 150*a*, so that the curl is corrected.

(b) As shown in FIG. 6, there is a curl correcting means which is composed of driving roller R1, driven roller R2, belt b which is trained about these driving roller R1 and driven roller R2, and roller R3 provided to be in pressure contact with the belt b. In this means, guide G for guiding copy sheet P is provided between the roller R3 and the belt b.

When the curled copy sheet P guided by the guide G passes through the contact surface between the belt b and roller R3, bending force in the direction opposite to that of the curl is applied on the copy sheet P, whereby the curl is corrected.

In addition to this, the curl correcting means of this type includes also one which is of a combination of rollers.

(c) The copy sheet P of this type is conveyed while it is sandwiched by a conveyance mechanism composed of belts and rollers, paired belts, or paired rollers. Conveyance speeds of adjoining conveyance mechanisms which are different from each other apply tension on the copy sheet P in the conveyance direction to correct the curl.

However, the curl correcting means in items (a)–(c) above and the electrophotographic copying machine shown in FIG. 4 have the following problems.

(1) In the sheet curl correcting means in item (a), even when the air flow is applied, moisture on the surface of copy sheet P on the part of pressure roller 150*b* is not evaporated sufficiently, resulting in insufficient correction of the curl.

(2) An amount of curl of copy sheet P varies depending on surroundings (temperature, humidity etc.) for an apparatus and a type of copy sheet P, and it is not constant. It is therefore necessary to change an amount of curl adjustment depending on environment of the apparatus and the type of copy sheet P in the sheet curl correcting means.

In the case of the sheet curl adjusting means as that in item (a) above, it is difficult to adjust the curl because of the constant rate of flow of the air flow.

In the case of the sheet curl adjusting means as that in item (b) above, fine adjustment of the curl is difficult because of dispersion of rubber strength in belts and rollers.

Further, in the case of the sheet curl adjusting means as that in item (b) above, a sheet curl adjusting unit is heated by heat accumulated in copy sheet P heated in the fixing section, causing thermal expansion of rubber on belts and rollers. Therefore, curl correction for the copy sheet P is reduced (or increased) and an amount of adjustment is not stabilized, which is a problem.

The sheet curl adjusting means as that in item (c) above does not employ a method to change an amount of curl adjustment by adjusting a speed difference of the conveyance mechanism.

(3) In the case of the sheet curl correcting means as that shown in FIG. 6, a metal subjected to sheet metal processing is used as guide G.

When the tip of a metallic guide is extended to the vicinity of a pressure contact portion (nip portion) between roller R3 and belt b, it is apprehended that the roller R3 and the belt b are damaged, therefore, curled copy sheet P can not be guided stably, causing a problem that poor conveyance occurs.

(4) In the case of an electrophotographic copying machine having an arrangement shown in FIG. 4, in the path through which copy sheet P ejected out of fixing section 150 advances to automatic duplex unit 180, there are two portions (portions A and B in FIG. 4) where the radius of curvature is small, and when the copy sheet P passes through these portions, its curl is increased.

In this case, if the radius of curvature at each of the portions A and B is made greater, an increase of curl can be prevented to a certain extent, but there is caused a problem that an apparatus has to be large in size.

SUMMARY OF THE INVENTION

The invention has been achieved in view of the problems mentioned above, and its first object is to provide a sheet curl correcting mechanism wherein an amount of curl correction can be increased.

The second object of the invention is to provide a sheet curl correcting mechanism wherein a full curl on a sheet can be corrected.

The third object is to provide an image forming apparatus wherein an amount of curl adjustment can be changed.

The fourth object is to provide an image forming apparatus which can be made small in size.

The first structure to solve the above-mentioned problem is represented by a sheet curl correcting mechanism in which a rotary object that is either one of an endless annular belt and a roller and a roller which is in pressure contact with the rotary object are included, and a curled sheet is caused to pass through the portion between the rotary object and the roller to be subjected to the bending force in the direction opposite to that of the curl so that the curl of the sheet is corrected, wherein a copy sheet is arranged to be in an air flow.

The second structure is represented by the sheet curl correcting mechanism of the first structure wherein the air flow hits the internal surface of the curl on the sheet mentioned above.

The third structure is represented by a sheet curl correcting mechanism in which a rotary object that is either one of an endless annular belt and a roller and a roller which is in pressure contact with the rotary object are included, and a curled sheet is caused to pass through the portion between the rotary object and the roller to be subjected to the bending force in the direction opposite to that of the curl so that the curl of the sheet is corrected, wherein there is provided an elastic guide that guides the sheet to the portion between the rotary object and the roller. Incidentally, as a material of the guide, a resin sheet of a soft type is preferable.

The fourth structure is represented by an electronic image forming apparatus having a sheet curl correcting mechanism in which a rotary object that is either one of an endless annular belt and a roller and a roller which is in pressure contact with the rotary object are included, and a curled sheet is caused to pass through the portion between the rotary object and the roller to be subjected to the bending force in the direction opposite to that of the curl so that the curl of the sheet is corrected, wherein it is possible to adjust a speed difference between a sheet conveyance speed of the sheet curl correcting mechanism and a sheet conveyance speed of the sheet conveyance mechanism that is either one of the sheet conveyance mechanisms arranged before and behind the sheet curl correcting mechanism.

The fifth structure is represented by an electronic image forming apparatus having a sheet curl correcting mechanism in which a rotary object that is either one of an endless annular belt and a roller and a roller which is in pressure contact with the rotary object are included, and a curled sheet is caused to pass through the portion between the rotary object and the roller to be subjected to the bending force in the direction opposite to that of the curl so that the curl of the sheet is corrected, wherein the sheet curl correcting mechanism is provided immediately behind the fixing section.

The sixth structure is represented by the electronic image forming apparatus in the fifth structure wherein the sheet curl correcting mechanism is located in the path extending from the fixing section to the automatic duplex unit.

The seventh structure is represented by an electronic image forming apparatus provided with a sheet curl correcting mechanism in which a rotary object that is either one of an endless annular belt and a roller and a roller which is in pressure contact with the rotary object are included, and a curled sheet is caused to pass through the portion between the rotary object and the roller to be subjected to the bending force in the direction opposite to that of the curl so that the curl of the sheet is corrected, a sheet conveyance path positioned to be in parallel with the sheet curl correcting mechanism, a switching means which switches a sheet advancement direction either to the sheet curl correcting mechanism or to the sheet conveyance path, a humidity sensor which senses humidity, and a control section which takes in signals from the humidity sensor and drives the switching means.

The control section takes in signals from the humidity sensor, and drives the switching means to cause the sheet advancement direction to be on the sheet curl correcting mechanism side, when the curl correction is necessary, namely, when the humidity is not lower than the prescribed value (for example, 80%).

Further, when the curl correction is not necessary, namely, when the humidity is not more than the prescribed value, the switching means is driven so that the sheet advancement direction is caused to be on the sheet conveyance mechanism side, by-passing the sheet curl correcting mechanism.

The eighth structure is represented by the electronic image forming apparatus according to the seventh structure wherein a temperature sensor which senses a temperature is provided, and the control section takes in signals from the humidity sensor and the temperature sensor and thereby drives the switching means.

DETAILED DESCRIPTION OF THE PREFERRED EMBODIMENT

Embodiments of the invention will be explained as follows, referring to drawings.

(1) First embodiment

Figure 1:
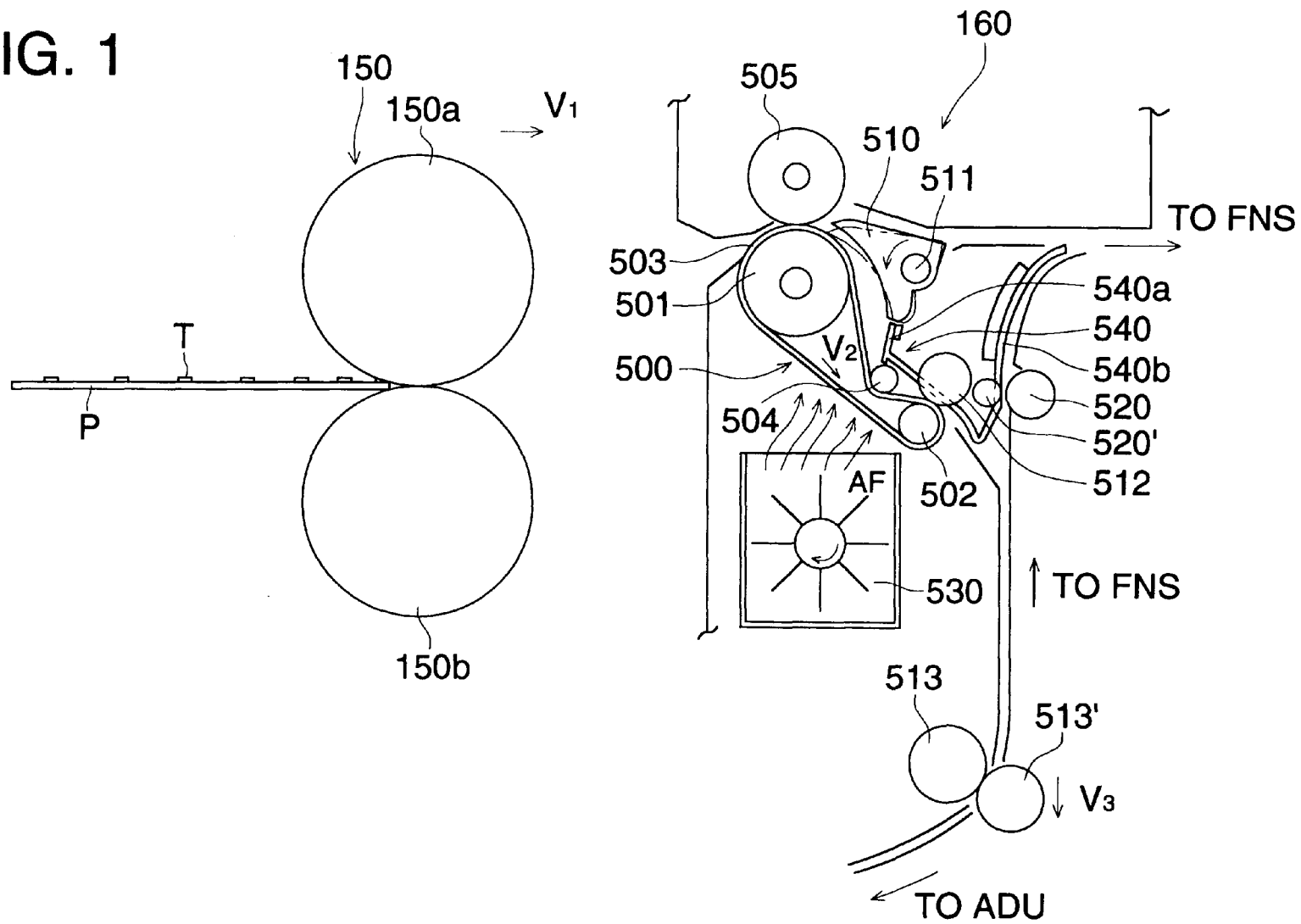
FIG. 1 is a structural diagram illustrating primary portions of the first embodiment of the invention.
Figure 2:
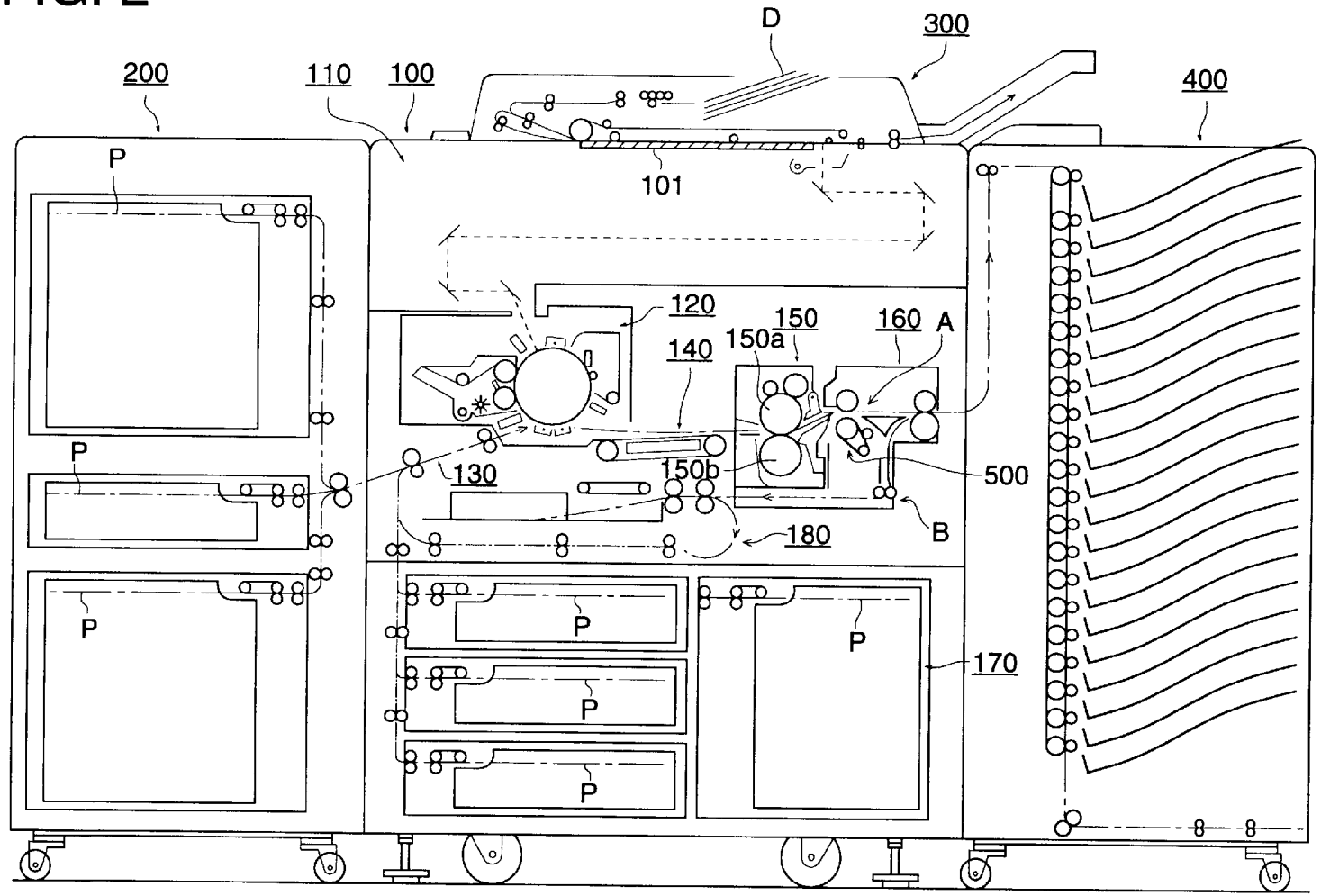
FIG. 2 is a structural diagram of an electrophotographic copying machine having therein an automatic duplex unit (ADU unit) as an image forming apparatus of the present embodiment.

FIG. 1 is a structural diagram illustrating primary portions of the first embodiment of the invention, and FIG. 2 is a structural diagram of an electrophotographic copying machine having therein an automatic duplex unit (ADU device) as an image forming apparatus of the present embodiment.

First, a general structure of an electrophotographic copying machine will be explained, referring to FIG. 2.

In the drawing, the numeral 100 represents an electrophotographic copying machine serving as an image forming apparatus, 200 represents a sheet-feeding unit (PFU device), 300 represents an automatic document feeding unit (ADU), and 400 represents a finisher device (finisher (sorter with a stapler device) FNS device).

The electrophotographic copying machine 100 is composed of scanning exposure section 110 which scans an entire surface of document D on platen glass 101 with a slit-shaped light, then leads optical information reflected on the document D to a photoreceptor drum through a mirror and a lens, and forms an electrostatic latent image on the photoreceptor drum, image forming section 120 which visualizes the electrostatic latent image on the photoreceptor drum by the use of toner (developing agent) and transfers it onto copy sheet P serving as a sheet, sheet-feeding section 130 which feeds the copy sheet P to the image forming section 120, conveyance section 140 which conveys the copy sheet P, fixing section 150 which is composed of heating roller 150*a* and pressure roller 150*b* wherein toner on the copy sheet P is heat-fixed by heat of the heating roller 150*a*, sheet-ejection switching section 160, plural sheet-feeding cassettes 170 and automatic duplex unit (ADU device) 180.

In the drawings, one-dot chain lines represent a conveyance path for copy sheet P. The conveyance path includes two types, one is a main route, and the other is a circulation route.

The main route is a route through which the copy sheet P loaded in sheet-feeding cassette 170 or sheet-feeding unit 200 provided in the lower part of the electrophotographic copying machine 100 is housed in finisher device 400 through conveyance section 140, fixing section 150 and sheet-ejection switching section 160, after an image is formed on the copy sheet P by image forming section 120, while the circulating route is a route through which the copy sheet P branched from the sheet-ejection switching section 160 is stocked temporarily in the automatic duplex unit 180, and then fed again to sheet-feeding section 130 of the electrophotographic copying machine 100.

In the present embodiment, sheet curl correcting mechanism 500 is provided immediately behind fixing section 150 on the path toward the automatic duplex unit 180 of sheet-ejection switching section 160.

Next, the sheet curl correcting mechanism 500 will be explained as follows, referring to FIG. 1. In the drawing, the numeral 501 represents a driving roller, while 502 represents a driven roller. About the driving roller 501 and the driven roller 502, there is trained endless annular belt 503. The numeral 504 represents a pressure roller which comes in pressure contact with the belt 503. These driving roller 501, driven roller 502, belt 503 and pressure roller 504 constitute the sheet curl correcting mechanism.

The numeral 505 is a conveyance roller which is provided to be capable of coming in contact with driving roller 501 through belt 503, and conveys copy sheet P ejected out of fixing section 150 into sheet-ejection switching section 160 while holding it together with the belt 503.

The numeral 510 is a gate which switches the advancement direction of copy sheet P conveyed by both conveyance roller 505 and driving roller 501. The gate 510 is provided to be rotatable around shaft 511, and when it is in its position shown with solid lines in FIG. 1, it guides copy sheet P toward the sheet curl correcting mechanism 500 (automatic duplex unit), while when the gate 510 is rotated counterclockwise around shaft 511 from the position shown with solid lines to the position shown with two-dot chain lines, it guides copy sheet P toward FNS.

The numeral 512 is a conveyance roller which is provided to be capable of coming in contact with driven roller 502 through belt 503, and conveys copy sheet P toward paired reversing/conveying rollers 513 and 513' together with the belt 503.

The paired reversing/conveying rollers 513 and 513' are paired conveyance rollers capable of rotating regularly and reversely, and they convey copy sheet P ejected out of sheet curl correcting mechanism 500 toward the automatic duplex unit by rotating regularly from the state of holding the copy sheet, and they convey toward FNS by rotating reversely. Incidentally, with regard to a point of difference between copy sheet P conveyed directly toward FNS at the gate 510 and copy sheet P conveyed toward FNS through paired reversing/conveying rollers 513 and 513', toner T on copy sheet P conveyed directly by the gate 510 toward FNS is located on the upper side of copy sheet P in FIG. 1, while toner T on copy sheet P conveyed toward FNS through paired reversing/conveying rollers 513 and 513' is located on the lower side of copy sheet P.

The numerals 520 and 520' represent a pair of conveyance rollers which hold and convey copy sheet P conveyed toward FNS by the paired reversing/conveying rollers.

The numeral 530 is an air blower such as a radial fan which drives air flow AF upon the sheet curl correcting mechanism 500. Incidentally, in the present embodiment, the position of the air blower 530 is established so that the air flow AF may hit the surface of copy sheet P facing the pressure roller 150*b* of the fixing section 150, namely the internal surface of the curl of the copy sheet P.

The numeral 540 is an elastic resin sheet. This resin sheet 540 is extended up to the vicinity of the pressure contact portion (nip portion) where pressure roller 504 presses belt 503 in sheet curl correcting mechanism 500, and it is composed of first guide section 540*a* which guides copy sheet P to the portion between the belt 503 and the pressure roller 504 and of second guide section 540*b* which guides copy sheet P conveyed toward FNS by paired conveyance rollers 520 and 520'.

Next, operations of the above-mentioned arrangement will be explained. A document is placed on platen glass 101 by automatic document feeder 300 or manually. Scanning exposure section 110 scans an entire surface of document D with a slit-shaped light, then leads optical information reflected on the document D to a photoreceptor drum through a mirror and a lens so that an electrostatic latent image may be formed on the photoreceptor drum.

On the other hand, sheet-feeding section 130 feeds copy sheet P to image forming section 120.

Then, the image forming section 120 visualizes the electrostatic latent image on the photoreceptor drum using toner (developing agent) and transfers it onto the copy sheet p.

The copy sheet P onto which toner T has been transferred is conveyed by conveyance section 140 to fixing section 150 where by conveyance section 140. Then, copy sheet P is heated and pressed by heating roller 150*a* and pressure roller 150*b* so that toner T on the copy sheet P is heat-fixed on the copy sheet P. In this case, the copy sheet P whose one side only has been heated by the heating roller 150*a* is curled.

The copy sheet P ejected out of the fixing section 150 enters sheet-ejection switching section 160. In this case, when gate 510 in the sheet-ejection switching section 160 is at the position shown with solid lines in FIG. 1, the copy sheet P sandwiched between and conveyed by conveyance roller 505 and belt 503 is guided toward the sheet curl correcting mechanism 500 where the curl of the copy sheet P is corrected by bending force in the direction opposite to that of the curl applied by the pressure roller 504.

Then, the copy sheet P is conveyed toward paired reversing/conveying rollers 513 by conveyance roller 512 and belt 503, and then is directed by the paired reversing/conveying rollers 513 and 513' toward automatic duplex unit (ADU) 180.

When the copy sheet P is directed to finisher device 400, the paired reversing/conveying rollers 513 and 513' stop rotating immediately after they sandwich the copy sheet P, and then rotate in the reverse direction. Then, the copy sheet P is conveyed toward finisher device (FNS) 400 through paired conveyance rollers 520 and 520'.

In FIG. 1, when the gate 510 is at the position shown with two-dot chain lines, the copy sheet P is conveyed toward finisher device (FNS) 400.

In the aforesaid arrangement, the curl of the copy sheet P is corrected by bending force in the direction opposite to that of the curl applied by sheet curl correcting mechanism 500 and pressure roller 504, and the curl is further corrected when an air flow coming from air blower 530 hits the copy sheet P and thereby moisture in the copy sheet P is evaporated.

In the present embodiment, in particular, an air flow hits the internal surface of the curl having therein much moisture (the surface of the copy sheet P facing the pressure roller 150*b*), and thereby evaporation of moisture on the internal surface is accelerated and the curl is further corrected.

When correcting the curl of copy sheet P heated in fixing section 150, the heated copy sheet P heats the sheet curl correcting mechanism 500 which however is also cooled by an air flow because it is arranged in the air flow, and cooling of the copy sheet P is not disturbed.

Further, due to the first guide section 540*a* which is formed on the elastic resin sheet 540 in a way to extend up to the vicinity of the pressure contact portion (nip portion) where pressure roller 504 presses belt 503, the curled copy sheet P can be guided surely without a possibility that the pressure roller 504 and the belt 503 are damaged.

Due to the sheet curl correcting mechanism 500 provided immediately behind the fixing section 150, the curl can be corrected, before the copy sheet P is dried sufficiently, namely, on the half way of occurrence of the curl, resulting in sure correction of the curl.

Accordingly, even when the conveyance path following the sheet curl correcting mechanism 500 has therein a point where the radius of curvature is small, the copy sheet P does not curl.

Further, due to the sheet curl correcting mechanism 500 provided on the path extending from the fixing section 150 to the automatic duplex unit 180, it is possible to provide portions where the radius of curvature is small (portions A and B in FIG. 2) on the path extending from the fixing section 150 to the automatic duplex unit 180, which makes an apparatus to be small.

It has been found that the effect of curl correction can be improved also by applying longitudinal tension on copy sheet P and thereby by controlling friction force for copy sheet P through the condition of V1<V2 or V2<V3 under the assumption that V1 represents a conveyance speed of the fixing section 150, V2 represents a conveyance speed of the sheet curl correcting mechanism 500 and V3 represents a conveyance speed of paired conveying/reversing rollers 513, as shown in FIG. 1.

In particular, it is possible to control an amount of correction by controlling the aforesaid friction force mentioned, and it is possible to correct curl surely by adjusting V1, V2 and V3 in accordance with surroundings of an apparatus and types of copy sheet P. To be concrete, it is possible to adjust V1, V2 and V3 mentioned above by setting in advance the rotational frequency of the conveyance roller in a conveyance section, namely, the rotational frequency of a driving motor (not shown) for the conveyance roller, or by making the rotational frequency to be selectable in the case of installation, depending on surroundings where the apparatus is installed such as those of high temperature and high humidity or of low temperature and low humidity. It is also possible to provide an input operating section so that V1, V2 and V3 mentioned above may be adjusted in accordance with types of copy sheet P.

(2) Second embodiment

Figure 3:
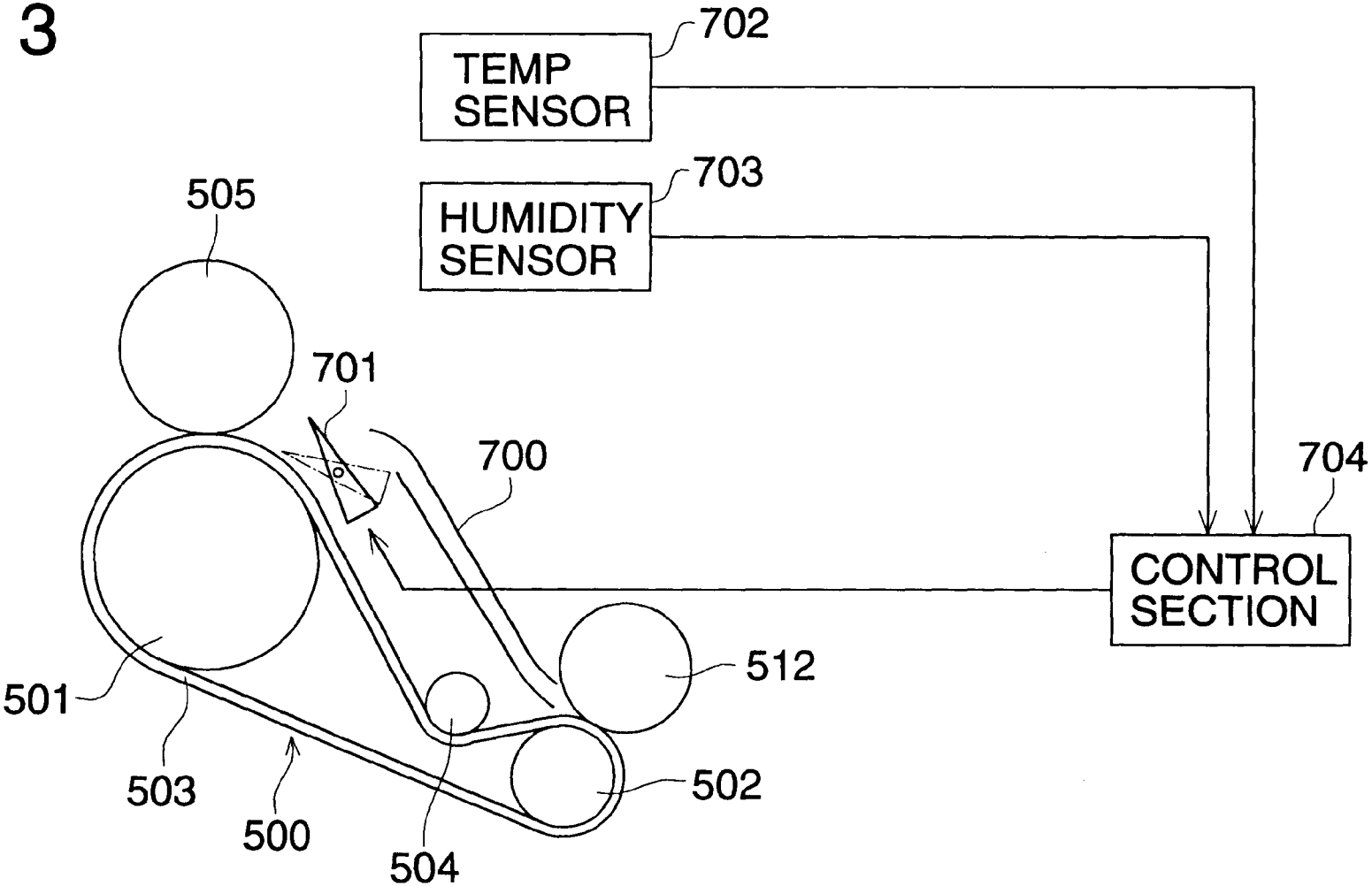
FIG. 3 is a structural diagram of primary portions of the second embodiment of the invention.
Figure 4:
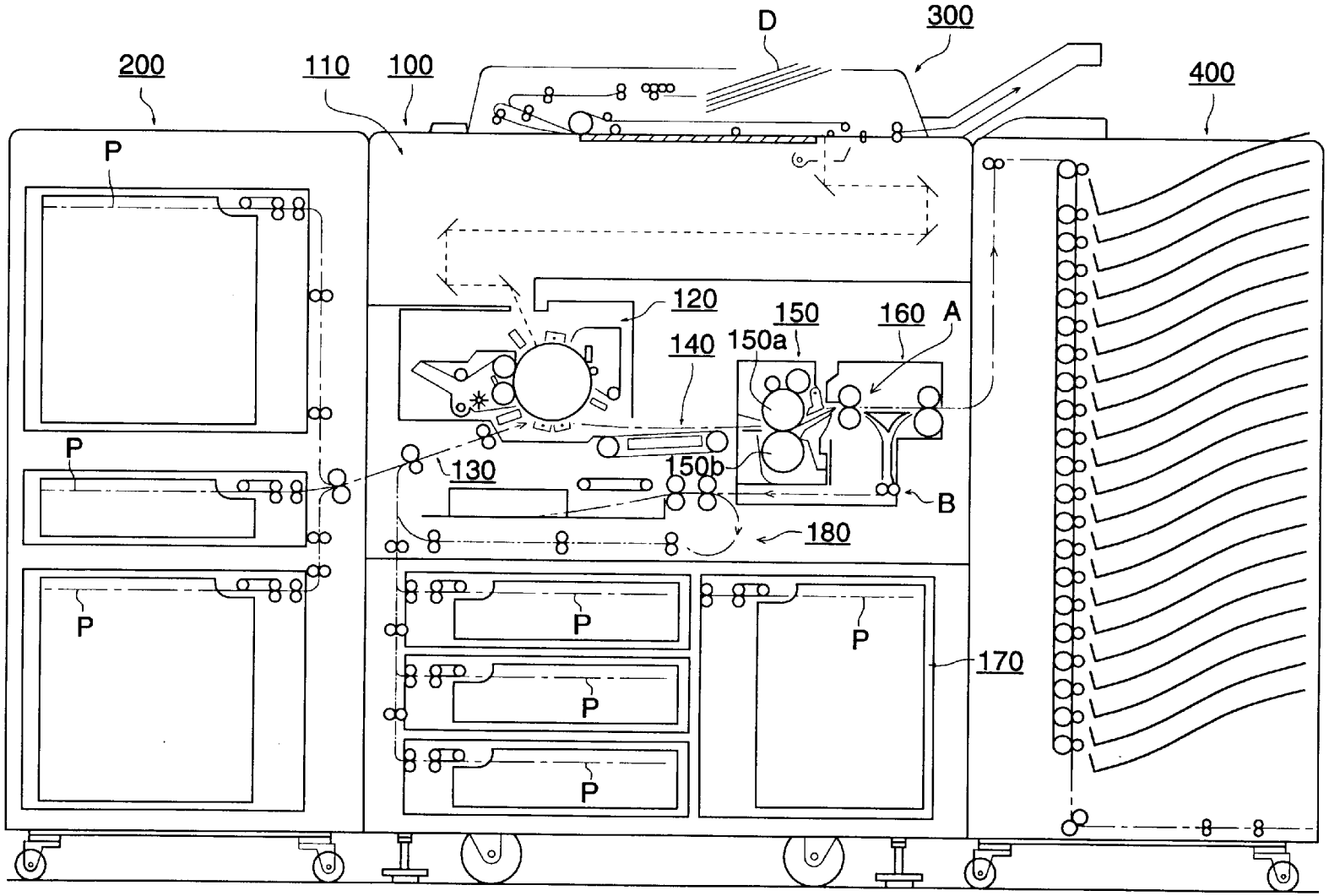
FIG. 4 is a structural diagram of an electrophotographic copying machine as an example of an electronic image forming apparatus having therein an automatic duplex unit (ADU unit).
Figure 5:
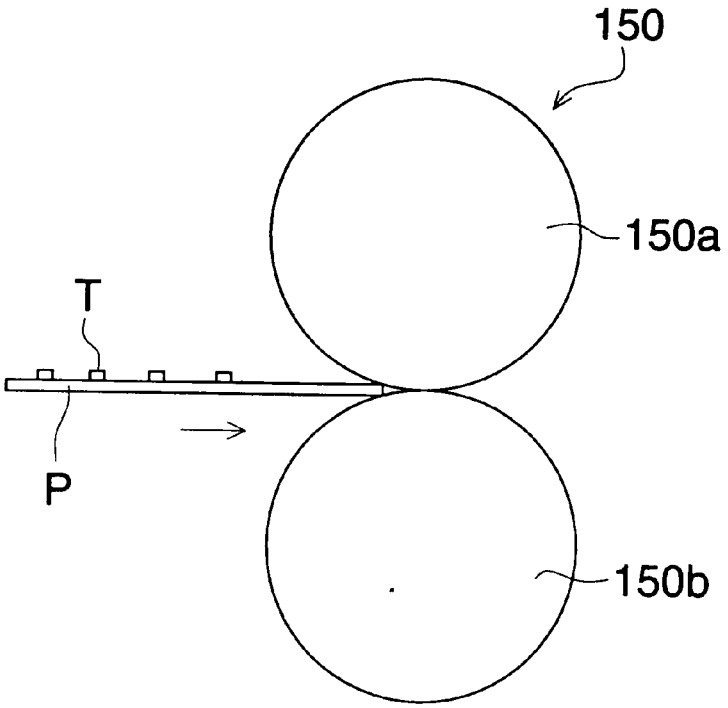
FIG. 5 is a diagram illustrating curls.
Figure 5:
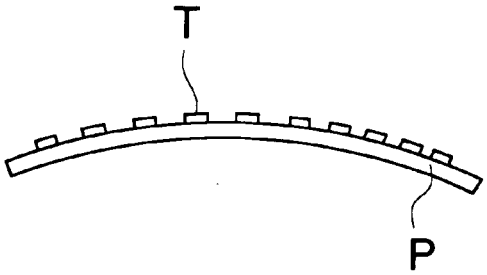
Figure 6:
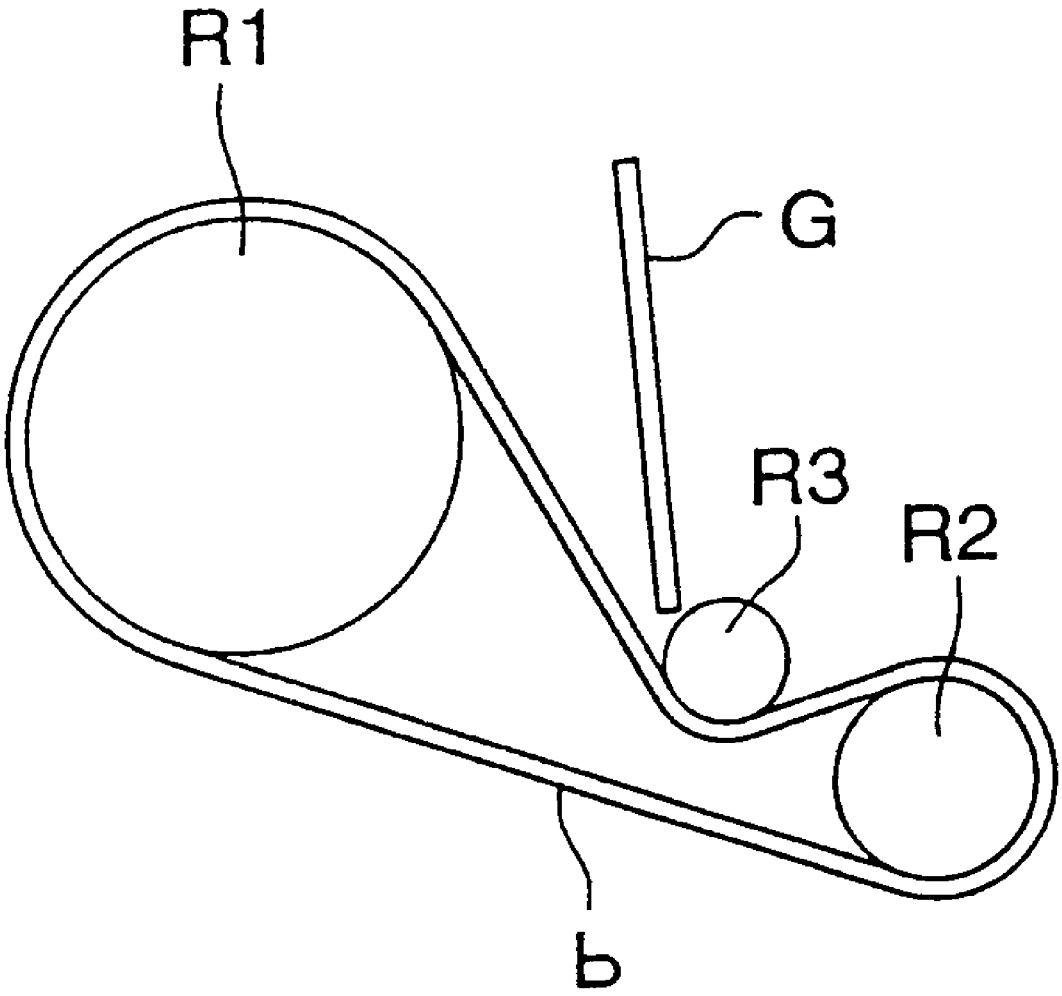
FIG. 6 PRIOR ART
FIG. 6 is a structural diagram of a conventional sheet curl correcting mechanism.

FIG. 3 is a structural diagram of primary portions of the second embodiment of the invention.

In the drawing, portions identical to those in FIG. 1 are given the same symbols, and explanation for them will be omitted. The numeral 700 is a sheet conveyance path provided in parallel with sheet curl correcting mechanism 500.

The numeral 701 represents a gate serving as a switching means which shunts copy sheet P sandwiched and conveyed by conveyance roller 505 and belt 503 to either of the sheet curl correcting mechanism 500 and the sheet conveyance path 700, namely, to the sheet curl correcting mechanism 500 when the gate is in the position shown with solid lines, and to the sheet conveyance path 700 when it is in the position shown with two-dot chain lines.

The numeral 702 is a temperature sensor, while 703 is a humidity sensor. The numeral 704 is a control section which takes in signals from the temperature sensor 702 and the humidity sensor 703, and drives gate 701 serving as a switching means to the position shown with solid lines or to the position shown with two-dot chain lines.

Operations in the arrangement mentioned above will be explained next. The control section 704 takes in signals from the temperature sensor 702 and the humidity sensor 703, and then drives the gate 701 to the position shown with solid lines so that copy sheet P is directed to the sheet curl correcting mechanism 500, when the curl correction is necessary, namely, when the temperature is not lower than the prescribed value (for example, 30° C. or more) or the humidity is not lower than the prescribed value (for example, 80%).

On the other hand, when the curl correction is not necessary, namely, when each of the temperature and humidity is lower than the prescribed value, the gate 701 is driven to the position shown with two-dot chain lines so that copy sheet P is directed to the sheet conveyance path 700 and the sheet curl correcting mechanism 500 is by-passed.

Therefore, the curl can surely be corrected under any conditions.

Incidentally, in the embodiment stated above, primary factor which necessitates curl correction is humidity. It is therefore possible to control the gate 701 only by humidity, by providing a humidity sensor.

As stated above, in the first structure of the invention wherein the sheet curl correcting mechanism is located in the air flow, the curl of a sheet can be corrected by bending force in the direction opposite to that of the curl applied by a roller, and further, moisture in the sheet is evaporated by the air flow jetting against the sheet so that the curl is further corrected.

When correcting the curl of the sheet heated in the fixing section, the heated sheet heats the sheet curl correcting mechanism which, however, is also cooled by an air flow because it is located in the air flow, and cooling of the sheet is not disturbed. Concurrently with this, the sheet curl correcting mechanism is cooled and is kept at a constant temperature, thereby the curl can be corrected surely without any change in correcting power by a belt and a roller.

In the second structure of the invention wherein the air flow of the first structure is arranged to jet against the internal surface of the curl on the sheet, evaporation of moisture on the internal surface is accelerated and the curl is further corrected.

In the third structure of the invention wherein an elastic guide which guides the sheet to the portion between the rotary object and the roller is provided, even when the tip of the guide is extended to the vicinity of the pressure contact portion (nip portion) where roller R3 presses belt B, the curled copy sheet P can be guided surely without a possibility that the roller R3 and the belt B are damaged.

In the fourth structure of the invention wherein it is possible to adjust a speed difference between a sheet conveyance speed of the sheet curl correcting mechanism and a sheet conveyance speed of the sheet conveyance mechanism that is either one of the sheet conveyance mechanisms arranged before and behind the sheet curl correcting mechanism, it is possible to correct the curl surely by adjusting a speed difference between a sheet conveyance speed of the sheet curl correcting mechanism and a sheet conveyance speed of the sheet conveyance mechanism that is either one of the sheet conveyance mechanisms arranged before and behind the sheet curl correcting mechanism, even when a curling amount is changed by the change of tension on the sheet in the conveyance direction and by surroundings of an apparatus including types of copy sheet P.

In the fifth structure of the invention wherein the sheet curl correcting mechanism is provided immediately behind the fixing section, the curl can be corrected surely because the curl is corrected, before the sheet is dried sufficiently, namely, on the half way of occurrence of the curl.

Accordingly, even if the conveyance path located behind the sheet curl correcting mechanism has therein a portion where the radius of curvature is small, that portion does not curl the sheet.

In the sixth structure of the invention wherein the sheet curl correcting mechanism in the fifth structure is provided on the path extending from the fixing section to the automatic duplex unit, an apparatus can be made small in size because it is possible to provide a portion where the radius of curvature is small on the path extending from the fixing section to the automatic duplex unit.

In the seventh structure wherein a sheet curl correcting mechanism, a sheet conveyance path arranged to be in parallel with the sheet curl correcting mechanism, a switching means which shunts the conveyance direction for a sheet either to the sheet curl correcting mechanism, or to the sheet conveyance path, a humidity sensor which senses humidity, and a control section which takes in signals from the humidity sensor and drives the switching means are provided, it is possible to correct the curl surely under any condition when the control section drives the switching means and thereby shunts the advancement direction of a sheet either to the sheet curl correcting mechanism, or to the sheet conveyance path, depending on the humidity.

In the eighth structure wherein a temperature sensor which senses temperature is provided in the seventh structure, it is possible to correct the curl more surely than in the seventh structure by switching either to the sheet conveyance mechanism or to the sheet curl correcting mechanism in accordance with humidity and temperature.

What is claimed is:

1. An electrophotographic image forming apparatus having a sheet curl correcting mechanism comprising:

(a) a rotary body including either an endless annular belt or a roller, (b) a pressing roller for pressing the rotary body, wherein a curled recording sheet has a recording surface on which a toner image is formed and said curled recording sheet is inserted between the rotary body and the pressing roller thereby bending force is applied to the curled recording sheet in a direction opposite to a curl of the curled recording sheet so that the curl is corrected; and (c) said apparatus further comprising an air flow generator for applying an air flow to a surface of said curled recording sheet opposite said recording surface of said curled recording sheet and the sheet curl correcting mechanism.

2. The sheet curl correcting mechanism of claim 1, wherein the recording surface of the curled recording sheet is in contact with the pressing roller.

3. The sheet curl correcting mechanism of claim 1 further comprising a resilient guide for guiding the curled recording sheet between the rotary body and the pressing roller.

4. The electrophotographic image forming apparatus of claim 1, wherein the sheet curl correcting mechanism is provided immediately behind a fixing unit.

5. An electrophotographic image forming apparatus having a sheet curl correcting mechanism comprising:

(a) a rotary body including either an endless annular belt or a roller; and (b) a pressing roller for pressing the rotary body;

wherein a curled recording sheet on which a toner image is formed is inserted between the rotary body and the pressing roller thereby bending force is applied to the curled recording sheet in a direction opposite to a curl of the curled recording sheet so that the curl is corrected;

and wherein a speed difference for applying tension to the curled recording sheet between a recording sheet conveyance speed inside the sheet curl correcting mechanism and one of a conveyance speed in a sheet conveyance mechanism provided before or behind the sheet curl correcting mechanism, is adjustable.

6. The electrophotographic image forming apparatus of claim 5, wherein the sheet curl correcting mechanism is provided immediately behind a fixing unit.

7. The electrophotographic image forming apparatus of claim 6, wherein the sheet curl correcting mechanism is provided in a conveyance path between the fixing unit and a duplex unit at which a recording sheet having a toner image on one side thereof is reversed for a toner image formation on the other side thereof.

8. The electrophotographic image forming apparatus of claim 5 further comprising a resilient guide for guiding the curled recording sheet between the rotary body and the pressing roller.

9. An electrophotographic image forming apparatus comprising:

(a) a sheet curl correcting mechanism for correcting curl of a recording sheet including (1) a rotary body including either an endless annular belt or a roller; and (2) a pressing roller for pressing the rotary body;

wherein a curled recording sheet on which a toner image is formed is inserted between the rotary body and the pressing roller thereby bending force is applied to the curled recording sheet in a direction opposite to a curl of the curled recording sheet so that the curl is corrected;

(b) a sheet conveying path provided in parallel to the sheet curl correcting mechanism, wherein said sheet conveying path does not apply bending force to the recording sheet;

(c) a switching means for switching an advance of the recording sheet either to the sheet curl correcting mechanism or the sheet conveying path;

(d) a humidity sensor for sensing humidity inside the apparatus; and (e) a controller for controlling the switching means according to a signal sensed by the humidity sensor such that the curled recording sheet is conveyed to the sheet curl correcting mechanism when humidity sensed by the humidity sensor is higher than a preset humidity, and the curled recording sheet is conveyed to the conveying path when humidity sensed by the humidity sensor is below the preset humidity.

10. The electrophotographic image forming apparatus of claim 9 further comprising a temperature sensor for sensing temperature inside the apparatus, wherein the controller controls the switching means according to signals sensed by the humidity sensor and the temperature sensor.

11. The electrophotographic image forming apparatus of claim 9 further comprising a resilient guide for guiding the curled recording sheet between the rotary body and the pressing roller.

12. The electrophotographic image forming apparatus of claim 9, wherein the sheet curl correcting mechanism is provided immediately behind a fixing unit.

* * * * *